US007098856B2

(12) United States Patent
Okado

(10) Patent No.: US 7,098,856 B2
(45) Date of Patent: Aug. 29, 2006

(54) ANTENNA AND DIELECTRIC SUBSTRATE FOR ANTENNA

(75) Inventor: Hironori Okado, Tokyo (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 10/654,432

(22) Filed: Sep. 4, 2003

(65) Prior Publication Data

US 2004/0100406 A1 May 27, 2004

(30) Foreign Application Priority Data

Nov. 27, 2002 (JP) ..... 2002-343290
Mar. 4, 2003 (JP) ..... 2003-056740
May 28, 2003 (JP) ..... 2003-150370

(51) Int. Cl.
*H01Q 1/38* (2006.01)
*H01Q 1/24* (2006.01)

(52) U.S. Cl. ..... 343/702; 343/700 MS

(58) Field of Classification Search ..... 343/700 MS, 343/767, 702, 770, 806, 895, 795, 865
See application file for complete search history.

(56) References Cited

U.S. PATENT DOCUMENTS 4,083,046 A 4/1978 Kaloi ..... 343/700 MS
4,151,531 A 4/1979 Kaloi ..... 343/700 MS
4,151,532 A 4/1979 Kaloi ..... 343/700 MS
4,500,887 A 2/1985 Nester ..... 343/700 MS
4,605,012 A 8/1986 Ringeisen et al. ..... 128/804
4,605,933 A 8/1986 Butscher ..... 343/700 MS
5,255,002 A 10/1993 Day ..... 343/713
5,521,606 A 5/1996 Iijima et al. ..... 343/713
5,532,707 A 7/1996 Klinger et al. ..... 343/793
5,847,682 A 12/1998 Ke ..... 173/48.1
5,872,546 A * 2/1999 Ihara et al. ..... 343/795
6,046,703 A 4/2000 Wang et al. ..... 343/795
6,097,345 A 8/2000 Walton ..... 343/769
6,133,879 A * 10/2000 Grangeat et al. .... 343/700 MS
6,157,344 A 12/2000 Bateman et al. ..... 424/85.6
6,232,925 B1 5/2001 Fujikawa ..... 332/105
6,249,254 B1 6/2001 Bateman et al. ..... 343/700 MS (Continued)

FOREIGN PATENT DOCUMENTS

EP 1 198 027 A1 4/2002

(Continued)

OTHER PUBLICATIONS

Honda et al., "Improved Input Impedance of Circular Disc Monopole Antenna," Spring National Convention of The Institute of Electronics, Information and Communication Engineers, pp, 2-131, B-131, 1992.

(Continued)

*Primary Examiner*—Shih-Chao Chen
*Assistant Examiner*—Minh Dieu A
(74) *Attorney, Agent, or Firm*—Oliff & Berridge, PLC

(57) ABSTRACT

An antenna comprises a ground pattern, and a planar element that is fed and equipped with a cut-out portion provided from the farthest edge portion formed from the feed position toward the ground pattern side, and the ground pattern and the planar element are juxtaposed with each other. The cut-out portion enables to further miniaturize the antenna and secure current paths to obtain radiation in a low-frequency range. Since the ground pattern and the planar element are juxtaposed with each other, the mount volume of the antenna can be reduced, and the antenna characteristic, particularly the impedance characteristic, can be easily controlled, and the bandwidth can be widened.

4 Claims, 16 Drawing Sheets

U.S. PATENT DOCUMENTS

| | | | | |
|---|---|---|---|---|
| 6,259,416 | B1 | 7/2001 | Qi et al. | 343/767 |
| 6,329,950 | B1 | 12/2001 | Harrell et al. | 343/700 MS |
| 6,351,246 | B1 * | 2/2002 | McCorkle | 343/795 |
| 6,452,548 | B1 | 9/2002 | Nagumo et al. | 343/700 MS |
| 6,515,626 | B1 * | 2/2003 | Bark et al. | 343/700 MS |
| 6,603,429 | B1 | 8/2003 | Bancroft et al. | 343/700 MS |
| 6,707,427 | B1 | 3/2004 | Konishi et al. | 343/700 MS |
| 6,720,924 | B1 * | 4/2004 | Tomomatsu et al. | 343/700 MS |
| 6,747,600 | B1 | 6/2004 | Wong et al. | 343/700 MS |
| 6,747,605 | B1 | 6/2004 | Lebaric et al. | 343/795 |
| 6,762,723 | B1 | 7/2004 | Nallo et al. | 343/700 MS |
| 6,768,461 | B1 | 7/2004 | Huebner et al. | 343/700 MS |
| 2002/0015000 | A1 | 2/2002 | Reece et al. | 343/725 |
| 2002/0026586 | A1 | 2/2002 | Ito | 343/183 |
| 2002/0122010 | A1 | 9/2002 | McCorkle | 343/795 |
| 2003/0020668 | A1 * | 1/2003 | Peterson | 343/846 |
| 2003/0034920 | A1 * | 2/2003 | Lee | 343/700 MS |
| 2003/0156064 | A1 | 8/2003 | Bancroft et al. | 343/700 MS |

FOREIGN PATENT DOCUMENTS

| | | |
|---|---|---|
| JP | JU-S31-000709 Y | 1/1956 |
| JP | A 55-4109 | 1/1980 |
| JP | A 57-142003 | 9/1982 |
| JP | A 63-275204 | 11/1988 |
| JP | U 5-76109 | 10/1993 |
| JP | JU H 05-82122 | 11/1993 |
| JP | A 6-291530 | 10/1994 |
| JP | U 3008389 | 12/1994 |
| JP | A 8-213820 | 8/1996 |
| JP | 0 831 548 A2 | 3/1998 |
| JP | A 10-98330 | 4/1998 |
| JP | A 11-27026 | 1/1999 |
| JP | A 2000-183789 | 6/2000 |
| JP | A 2001-156532 | 6/2001 |
| JP | A 2001-203529 | 7/2001 |
| JP | A 2001-217632 | 8/2001 |
| JP | A 2002-100915 | 4/2002 |
| JP | A 2002-171126 | 6/2002 |
| JP | A 2002-252515 | 9/2002 |
| JP | A 2002-319811 | 10/2002 |

OTHER PUBLICATIONS

Ihara et al., "Broadband Characteristics of Semi-Circular Antenna combined with Linear Element," General Convention of The Society of Electronics, Information and Communication Engineers, pp. 77, B-77, 1996.

Ihara et al., "A small Broadband Antenna with Rounded Semi-Circular Element," Society Conference of The Institute of Electronics, Information and Communication Engineers, pp. 78, B-78, 1996.

Honda et al., "Wideband Monopole Antenna of Circular Disc," Technical Reports of The Institute of Television, vol., 15, No. 59, pp. 25-30.

* cited by examiner

ANTENNA AND DIELECTRIC SUBSTRATE FOR ANTENNA

TECHNICAL FIELD OF THE INVENTION

The present invention relates to a wide bandwidth antenna.

BACKGROUND OF THE INVENTION

For example, JP-A-57-142003 discloses the following antennas. That is, it discloses a monopole antenna in which a flat-plate type radiation element 1001 having a disc shape is erected vertically to an earth plate or the ground 1002 as shown in FIGS. 22A-1 and 22A-2. This monopole antenna is designed so that a high-frequency power source 1004 and the radiation element 1001 are connected to each other through a power feeder 1003 and the height of the top portion of the radiation element 1001 is set to a quarter wavelength. Furthermore, it also discloses a monopole antenna in which a flat-plate type radiation element 1005 whose upper peripheral edge portion has a shape extending along a predetermined parabola is erected vertically to an earth plate or the ground 1002. Still furthermore, it discloses a dipole antenna in which two radiation elements 1001 of the monopole antenna shown in FIGS. 22A-1 and 22A-2 are symmetrically arranged as shown in FIG. 22C. Still furthermore, it discloses a dipole antenna in which two radiation elements 1005 of the monopole antenna shown in FIGS. 22B-1 and 22B-2 are symmetrically arranged as shown in FIG. 22D.

In addition, JP-A-55-4109 discloses the following antennas, for example. That is, a sheet-type elliptical antenna 1006 is erected vertically to a refection surface 1007 so that the major axis thereof is parallel to the reflection surface 1007, and power supply is carried out through a coaxial power feeder 1008, as shown in FIG. 22E. FIG. 22F shows an example where the antenna is configured as a dipole. In the case of the dipole type, the sheet-type elliptical antennas 1006*a* are arranged on the same plane so that the minor axes thereof are located on the same line, and a slight gap is disposed so that a balanced feeder 1009 is connected to both the antennas.

Besides, a monopole antenna as shown in FIG. 22G is disclosed in "B-77: BROADBAND CHARACTERISTICS OF SEMI-CIRCULAR ANTENNA COMBINED WITH LINEAR ELEMENT", Taisuke Ihara, Makoto Kijima and Koichi Tsunekawa, pp77 General Convention of The Institute of Electronics, Information and Communication Engineers, 1996 (hereinafter referred to as "non-patent document 1"). As shown in FIG. 22G, a semicircular element 1010 is erected vertically to an earth plate 1011, and the nearest point of the arc of the element 1010 to the earth plate 1011 serves as a feed portion 1012. The non-patent document 1 shows that the frequency $f_L$ at which the radius of the circle almost corresponds to a quarter wavelength is the lower limit. Furthermore, it also describes an example where an element 1013 achieved by forming a cut-out portion in the element 1010 shown in FIG. 22G is erected vertically to the earth plate 1011 as shown in FIG. 22H, and that little difference exists in VSWR (Voltage Standing Wave Ratio) characteristic between the monopole antenna shown in FIG. 22G and the monopole antenna shown in FIG. 22H. Furthermore, it also discloses an example where an element 1014, which is formed by connecting an element 1014*a*, which resonates at $f_L$ or less and has a meander monopole structure, to an element with the cut-out portion as shown in FIG. 22H, is erected vertically to the earth plate 1011 as shown in FIG. 22I. Incidentally, the element 1014*a* is disposed to be accommodated in the cut-out portion. The antenna resonates at a frequency lower than $f_L$ because of the element 1014*a*, however, the VSWR characteristic is bad. In connection with the non-patent document 1, disc type monopole antennas are described in "B-131 IMPROVED INPUT IMPEDANCE OF CIRCULAR DISC MONOPOLE ANTENNA", Satoshi Honda, Yuken Ito, Hajime Seki and Yoshio Jinbo, 2-131, SPRING NATIONAL CONVENTION of The Institute of Electronics, Information and Communication Engineers, 1992, and "WIDEBAND MONOPOLE ANTENNA OF CIRCULAR DISC", Satoshi Honda, Yuken Ito, Yoshio Jinbo and Hajime Seiki, Vol. 15, No. 59, pp.25–30, 1991.10.24 in "TECHNICAL REPORTS OF THE INSTITUTE OF TELEVISION".

The antennas described above pertain to a monopole antenna in which a flat-plate conductor having various shapes is erected vertically to the ground surface, and a symmetric dipole antenna using two flat-plate conductors having the same shape.

In addition, FIG. 23 shows a glass antenna device for an automobile telephone disclosed in JP-A-8-213820. In FIG. 23, a fan-shaped radiation pattern 1033 and a rectangular ground pattern 1034 are formed on a window glass 2, a feed point A is connected to the core wire 1035*a* of a coaxial cable 1035, and a ground point B is connected to the outer conductor 1035*b* of the coaxial cable 1035. In this publication, the shape of the radiation pattern 1033 may be an isosceles triangular shape or a polygonal shape.

Furthermore, U.S. Pat. No. 2002-122010A1 discloses an antenna 1020 in which a tapered clearance area 1023 and a driven element 1022 whose feed point 1025 is connected to a transmission line 1024 are provided within a ground element 1021 as shown in FIG. 24. Incidentally, the gap between the ground element 1021 and the driven element 1022 is maximum at the opposite side to the feed point 1025 on the driven element 1022, and the gap therebetween is minimum in the neighborhood of the feed point 1025. The driven element 1022 is equipped with a concavity at the opposite side to the feed point 1025 of the driven element 1022. The concavity itself is opposite to the ground element 1021, and it serves as means for adjusting the gap between the driven element 1022 and the ground element 1021.

As described above, though various antennas have been hitherto known, the conventional vertical mount type monopole antennas have problems that their sizes are large, and it is difficult to control the antenna characteristic since it is difficult to control the distance between the radiation conductor and the ground surface. Furthermore, the conventional symmetrical type dipole antennas also have a problem that it is difficult to control the antenna characteristic since the radiation conductors have the same shape, thereby it is difficult to control the distance between the radiation conductors.

In addition, though it is described that the glass antenna device for the automobile telephone disclosed in JP-A-8-213820 has an excellent sensitivity and directional characteristic at 800 MHz and 1.5 GHz, the bandwidth is not sufficiently broad. Furthermore, this publication never discloses provision of any cut-out portion.

In addition, though the antenna of U.S. Pat. No. 2002-122010A1 aims at miniaturization, the structure that the driven element is provided within the ground element cannot achieve the sufficient miniaturization because the ground element fully surrounds the driven element.

SUMMARY OF THE INVENTION

In view of the foregoing problems, an object of the present invention is to provide an antenna having a novel shape that can be miniaturized and widened in bandwidth, and a dielectric substrate for the antenna concerned.

Furthermore, another object of the present invention is to provide an antenna having a novel shape that can be miniaturized and make it easy to control the antenna characteristic, and a dielectric substrate for the antenna concerned.

Still another object of the present invention is to provide an antenna having a novel shape that can be miniaturized and improved in characteristic in a low frequency range, and a dielectric substrate for the antenna concerned.

In order to attain the above objects, an antenna according to a first aspect of the present invention comprises a ground pattern and a planar element that has a feed point and a cut-out portion formed at an edge portion being opposite to the ground pattern side of said planar element, and the ground pattern and the planar element is juxtaposed with each other extending along counter directions respectively.

By providing the cut-out portion, the miniaturization can be further enhanced, and a current path for obtaining radiation in the low frequency range can be secured. With respect to the conventional technique in which the radiation conductor is vertically erected to the ground surface, the antenna characteristic cannot be controlled by the cut-out portion by the cut-out portion. However, according to this invention, the antenna characteristic can be controlled. Furthermore, since the ground pattern and the planar element are juxtaposed with each other, the mount volume of the antenna can be reduced, the antenna characteristic, particularly the impedance characteristic, can be easily controlled, and the wide bandwidth can be achieved.

Incidentally, the aforementioned planar element maybe disposed so that the edge portion other than the cut-out portion of the planar element is opposite to the ground pattern. If the ground pattern portion and the planar element portion can be separated from each other, the miniaturization of the antenna can be facilitated. Furthermore, other parts may be mounted on the ground pattern. In this case, the miniaturization can be enhanced also as the entire communication device.

Furthermore, the aforementioned ground pattern may be formed without fully surrounding the edge portion of the planar element.

Incidentally, the cut-out portion may be designed to have a rectangular shape. However, the cut-out portion may be designed to have other shapes. Furthermore, the cut-out portion may be formed symmetrically with respect to a line passing through the feed position of the planar element.

Furthermore, the aforementioned planar element may be designed to have such a shape that a bottom side thereof is adjacent to the ground pattern, lateral sides thereof is provided vertically or substantially vertically to the bottom side and a top side thereof is equipped with the cut-out portion. In addition, both the corners of the bottom side may be splayed.

Furthermore, at least one of the planar element and the ground pattern may have a portion that causes to continuously vary the distance therebetween. Thus, the antenna characteristic, particularly the impedance characteristic, can be easily controlled and the bandwidth can be widened.

Furthermore, at least a part of the edge of the planar element, which is opposite to the ground pattern, may be designed to be curved.

Still furthermore, the planar element may be formed on the dielectric substrate. The further miniaturization is enhanced.

Incidentally, it can be said that the ground pattern and the planar element or the dielectric substrate are not opposite each other, and both the planes thereof are parallel or substantially parallel to each other, or the ground pattern and the planar element or the dielectric substrate are not completely overlapped with each other and both the planes thereof are parallel or substantially parallel to each other.

An antenna dielectric substrate according to a second aspect of the present invention has a layer formed of a dielectric material, and a layer containing a conductor having a cut-out portion formed from an edge portion nearest to a first side surface of the antenna dielectric substrate toward a second side surface opposite to the first side surface. By using such the dielectric substrate, a compact-size antenna having a wide bandwidth (particularly, having an excellent characteristic in a low frequency range) can be implemented.

Incidentally, the cut-out portion may be designed in a rectangular shape. However, the shape of the cut-out portion may be other shape. Furthermore, the cut-out portion may be designed to have a symmetrical shape with respect to a line passing through the feed point of the conductor.

In addition, the aforementioned conductor may be designed to have such a shape that the side thereof nearest to the second side surface is a bottom side, lateral sides thereof are provided vertically or substantially vertically to the bottom side and the top side nearest to the first side surface is equipped with the cut-out portion. Incidentally, both the corners of the bottom side may be splayed.

In addition, the edge portion of the conductor, which is nearest to the second side surface, may have a portion, which continuously varies the distance with the second side surface. Furthermore, the conductor may have a connection portion to be connected to an electrode provided on at least the second side surface.

BRIEF DESCRIPTION OF THE DRAWINGS

FIGS. 22A-1, 22A-2, 22B-1, 22B-2, 22C, 22D, 22E, 22F, 22G, 22H, and 22I are diagrams showing the structures of conventional antennas;

DETAILED DESCRIPTION OF THE PREFERRED EMBODIMENTS

Preferred embodiments according to the present invention will be described with reference to the accompanying drawings.

1. First Embodiment

Figure 1A:
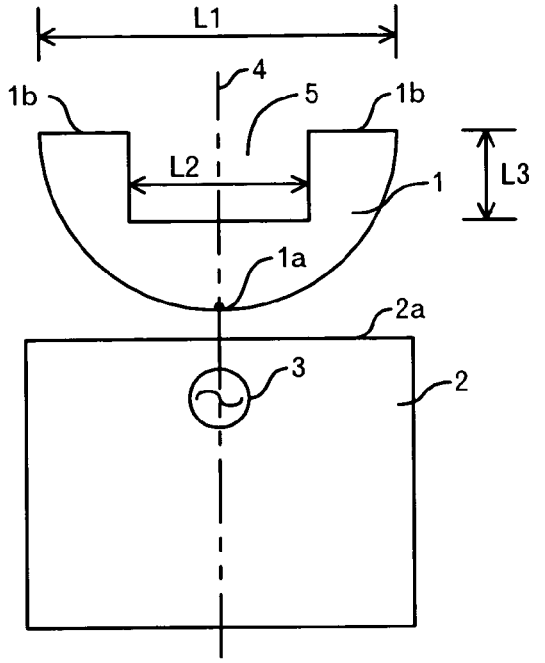
FIG. 1A is a front view showing the structure of an antenna according to a first embodiment.
Figure 1B:
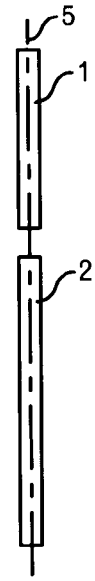
FIG. 1B is a side view of the antenna shown in FIG. 1A.

The structure of an antenna according to a first embodiment of the present invention is shown in FIG. 1A and FIG. 1B. The antenna according to this embodiment is composed of a planar element 1 formed of a semicircular conductive flat plate and having a cut-out portion 5, a ground pattern 2 juxtaposed with the planar element 1, and a high-frequency power source 3 connected to the feed point 1*a* of the planar element 1. The diameter L1 of the planar element 1 is set to 20 mm, for example. The aperture L2 of the cut-out portion 5 is set to 10 mm, for example, and the rectangular concavity whose depth is L3 (=5 mm) is formed from the top portion 1*b* (i.e. the edge portion farthest from the feed point 1*a*) of the planar element 1 toward the ground pattern 2 side, for example. The feed point 1*a* is located at such a position that the distance between the planar element 1 and the ground pattern 2 is shortest.

The planar element 1 and the ground pattern 2 are designed symmetrically with respect to a line 4 passing through the feed point 1*a*, and also the cut-out portion 5 is designed to be symmetrical with respect to the line 4. Furthermore, the shortest distance from any point on the arc of the planar element 1 to the ground pattern 2 is also symmetrical with respect to the line 4. That is, if the distance from the line 4 to each of two points on the arc of the planar element 1 is the same, the shortest distance from each of the two points on the arc of the planar element 1 to the ground pattern 2 is the same.

In this embodiment, a side 2*a* of the ground pattern 2 opposite to the edge of the planar element 1 is a line. Accordingly, the shortest distance between arbitrary point on the arc of the planar element 1 and the side 2*a* of the ground pattern 2 gradually increases continuously and curvedly along the arc as being farther away from the feed point 1*a*. That is, the antenna according to this embodiment is equipped with a continuous varying portion at which the distance between the planar element 1 and the ground pattern 2 is continuously varied. By providing such a continuous varying portion, the coupling degree between the planar element 1 and the ground pattern 2 is adjusted. By adjusting the coupling degree, especially, the bandwidth at a high frequency side can be widened.

Furthermore, according to this embodiment, the planar element 1 is disposed on the center line 5 of the ground pattern 2 as shown in FIG. 1B. Accordingly, in this embodiment, the planar element 1 and the ground pattern 2 are located on the same plane. However, they are not necessarily located on the same plane, and they may be disposed so that the planes thereof are parallel or substantially parallel to each other.

Furthermore, according to this embodiment, the planar element 1 is disposed so that the edge portion other than the cut-out portion 5 provided in the planar element 1 is opposite to the edge of the ground pattern 2. On the contrary, the edge portion at which the cut-out portion 5 is provided does not face the edge of the ground pattern 2, and is also not surrounded by the ground pattern 2. That is, since the planar element 1 portion and the ground pattern 2 portion are clearly separated from each other, it is unnecessary to provide an useless area of the ground pattern 2 and the miniaturization is facilitated. In addition, if the ground pattern 2 portion and the planar element 1 portion are separated from each other, other parts can be mounted on the ground pattern 2, thereby the miniaturization can be also enhanced as the entire communication device. This feature is common among all the embodiments described below.

Figure 2:
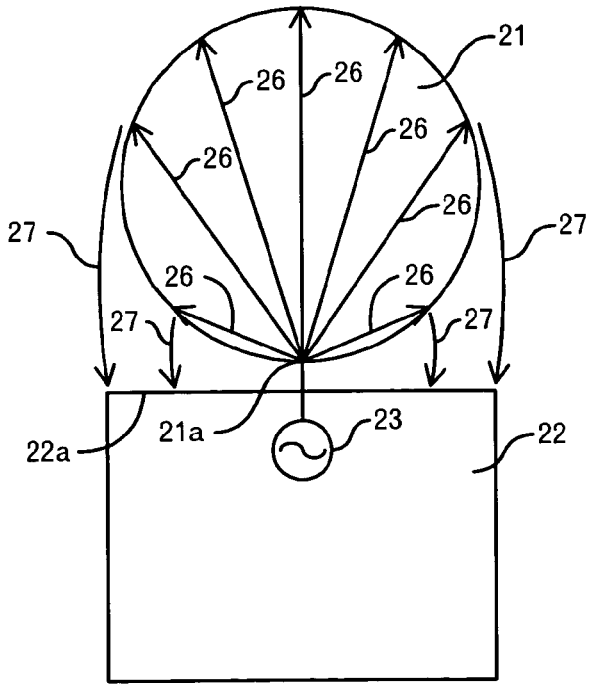
FIG. 2 is a diagram to explain the principle of the operation of the antenna containing a circular planar element.

In order to describe the operation principle of the antenna shown in FIGS. 1A and 1B, the operation principle when a circular planar element is used and the operation principle when a semicircular planar element is used will be first described. When a circular planar element shown in FIG. 2 is used, each current path 26 spreading radially from a feed point 21*a* to the circumference of the circular planar element 21 forms a resonance point. Therefore, continuous resonance characteristics can be achieved, and the bandwidth can be widened. In the case of FIG. 2, since the current path corresponding to the diameter of the circular planar element 21 is longest, the frequency at which the length of the diameter corresponds to a quarter wavelength is almost equal to the lower limit frequency and such continuous resonance characteristics can be achieved at the lower limit frequency or more.

Furthermore, electromagnetic coupling 27 due to current flowing on the circular planar element 21 occurs between the circular planar element 21 and the ground pattern 22 as shown in FIG. 2. That is, when the frequency is lower, the current path 26 contributing to the radiation erects vertically to a side 22*a* of the ground pattern 22, and coupling occurs in a wide range between the circular planar element 21 and the ground pattern 22. On the other hand, when the frequency is higher, the current path is inclined toward the horizontal direction, so that coupling occurs between the circular planar element 21 and the ground pattern 22 in a narrow range. It is considered that the coupling between the circular planar element 21 and the ground pattern 22 corresponds to a capacitance component C in an impedance equivalent circuit of an antenna, and the value of the capacitance component C varies in accordance with the degree of inclination of the current path. When the value of the capacitance component C varies, it greatly affects the impedance characteristic of the antenna. More specifically, the capacitance component C relates to the distance between the circular planar element 21 and the ground pattern 22.

Incidentally, when the disc is erected vertically to the ground surface like the prior art, the distance between the ground surface and the disc cannot be minutely controlled. On the other hand, when the planar element 1 or the circular planar element 21 is juxtaposed with the ground pattern 2 or 22 as shown in FIGS. 1A and 1B and FIG. 2, the capacitance component C in the impedance equivalent circuit of the antenna can be changed by altering the shape of the ground pattern 2 or 22. Accordingly, the antenna can be designed to achieve a preferable antenna characteristic.

Figure 3:
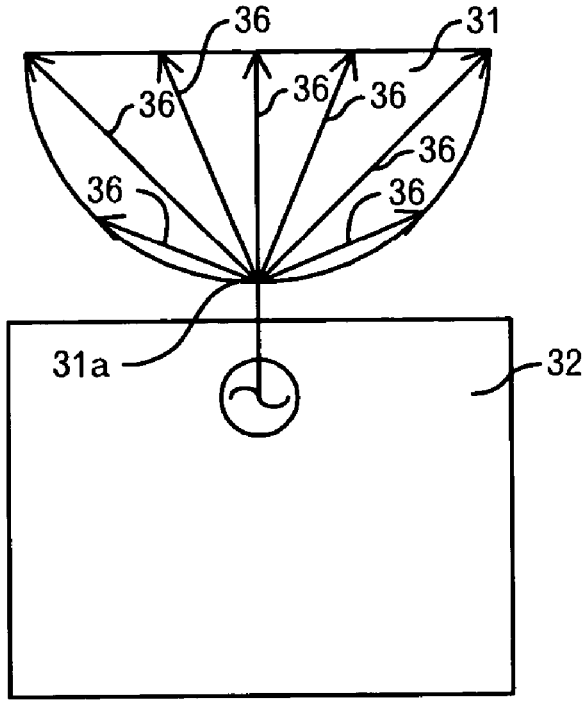
FIG. 3 is a diagram to explain the principle of the operation of the antenna containing a semi-circular planar element.

Next, a case will be considered in which a semicircular planar element 31 is used as shown in FIG. 3, since the size of the semicircular planar element is smaller than that of the circular planar element. Also in this case, each current path 36 spreading radially from a feed point 31*a* to the outer periphery containing the arc of the semicircular planar element 31 forms a resonance point to thereby achieve continuous resonance characteristics as in the case of the circular planar element 21 shown in FIG. 2. However, in the case of FIG. 3, since the shape of the planar element is changed from the circular shape to the semicircular shape, the length of the current path is shorter than in the case where the circular planar element is used. Though some current paths are longer than the radius of the circle, the frequency at which the length of the radius of the circle corresponds to the quarter wavelength is almost equal to the lower limit frequency. Therefore, there occurs a problem that the characteristic especially in the low frequency range is lowered due to the effect of miniaturization.

Figure 4:
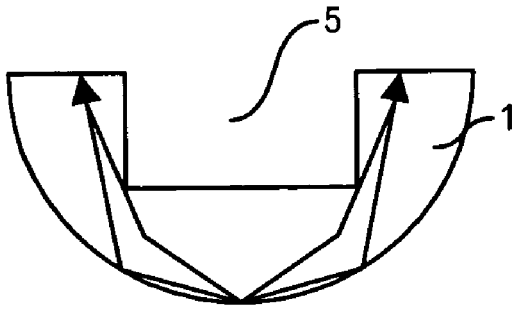
FIG. 4 is a diagram to explain the principle of the operation of the antenna according to the first embodiment.

Accordingly, by providing the cut-out portion 5 for the planar element 1 like this embodiment shown in FIGS. 1A and 1B, the current is prevented from linearly flowing from the feed point 1*a* to the top portion 1*b* by the cut-out portion 5 as shown in FIG. 4, and detours around the cut-out portion 5 as shown in FIG. 4. As described above, since the current path is formed so as to detour around the cut-out portion 5, it becomes longer, and the lower limit frequency of the radiation can be lowered. Accordingly, the bandwidth can be widened.

With respect to the antenna of this embodiment, the antenna characteristic can be controlled by the shape of the cut-out portion 5 and the distance between the planar element 1 and the ground pattern 2. However, it has been known that it is impossible to control the antenna characteristic by the cut-out portion in such an antenna that a radiation conductor is erected vertically to the ground surface like the prior art (see the non-patent document 1). On the other hand, if the planar element 1 and the ground pattern 2 are juxtaposed with each other like this embodiment, the antenna characteristic can be controlled by the cut-out portion 5.

Figure 5:
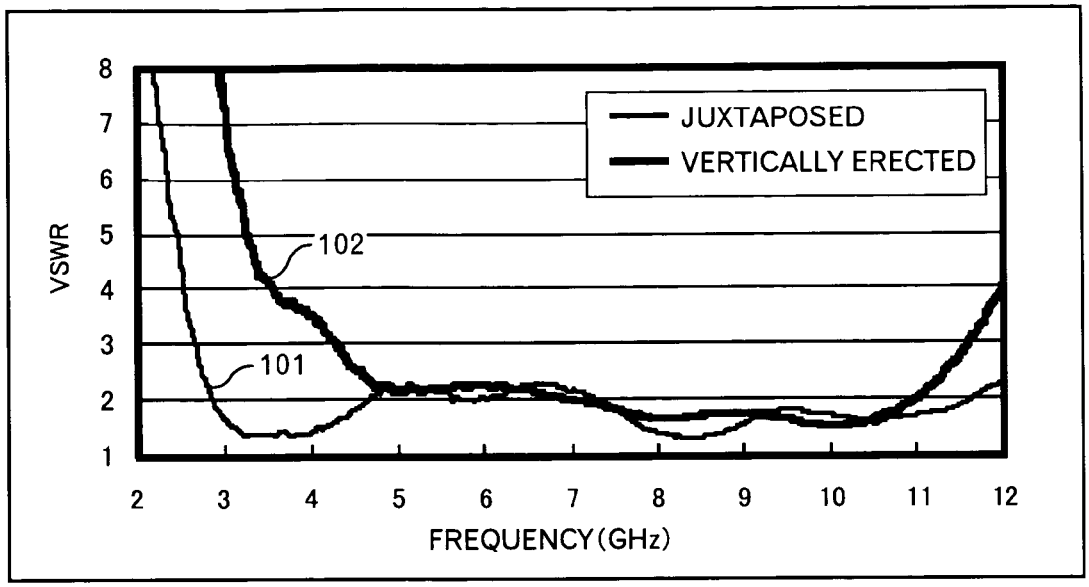
FIG. 5 is a graph showing the impedance characteristics of the antenna according to the first embodiment and a conventional antenna.

FIG. 5 is a graph showing the impedance characteristic when the planar element 1 is erected vertically to the ground surface like the prior art, and also the impedance characteristic of the antenna according to this embodiment shown in FIGS. 1A and 1B. In FIG. 5, the axis of ordinate represents VSWR, and the axis of abscissa represents the frequency. In the frequency characteristic of the antenna according to this embodiment represented by a solid line 101, the value of VSWR becomes less than 2 at a lower frequency than 3 GHz, and it is almost equal to about 2 until the frequency increases and exceeds 11 GHz although VSWR is slightly over 2 in the frequency range between 5 GHz and 7 GHz. On the other hand, in the frequency characteristic of the antenna according to the prior art represented by a thick line 102, VSWR does not have the same values as this embodiment until the frequency reaches about 5 GHz, and the value of VSWR increases at a frequency of about 11 GHz. That is, the antenna of this embodiment exhibits a remarkable effect that the characteristic is more excellent in the low frequency range and the high frequency range.

As described above, there is not only an effect that the distance between the planar element 1 and the ground pattern 2 can be easily controlled, but also an effect that the bandwidth can be stably widened by the "juxtaposition" of the planar element 1 and the ground pattern 2. In addition, the planar element 1 can be miniaturized by the cut-out portion 5.

Incidentally, it is not shown, but a shape of the portion of the ground pattern 2, which is opposite to the edge of the planar element 1, may be changed so as to be tapered. The shape can control the antenna characteristic as well as the shape of the cut-out portion 5 in a desired style.

In addition, the planar element 1 of this embodiment may be considered as a radiation conductor of a monopole antenna like the prior arts. On the other hand, since the ground pattern 2 of the antenna of this embodiment partially contributes to radiation, the antenna of this embodiment is also considered as a dipole antenna. However, since the dipole antenna normally uses two radiation conductors having the same shape, the antenna of this embodiment may be called as an asymmetrical dipole antenna. Furthermore, the antenna of this embodiment is considered as a traveling wave antenna. Such considerations can be applied to all the embodiments described below.

Furthermore, the shape of the cut-out portion 5 is not limited to the rectangular shape. For example, an inverted triangular cut-out portion 5 may be used. In this case, the feed point 1*a* and one apex of the inverted triangle are arranged to be located on the line 4. Still furthermore, the cut-out portion 5 may be designed in a trapezoidal shape. In the case of the trapezoid, if the bottom side is designed to be longer than the top side, the detour length at which the current path detours around the cut-out portion 5 is increased. Accordingly, the current path in the planar element 1 can be more increased. The corners of the cut-out portion 5 may be rounded.

2. Second Embodiment

Figure 6:
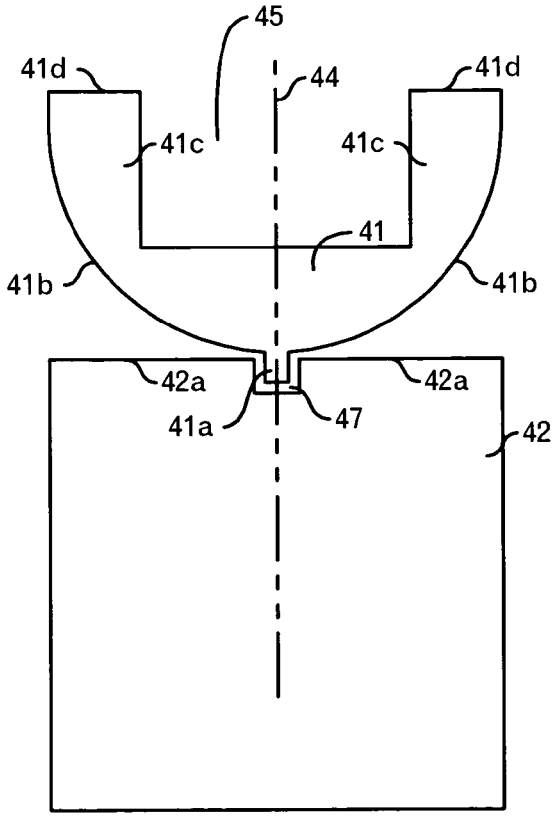
FIG. 6 is a diagram showing the structure of an antenna according to a second embodiment.

FIG. 6 shows the structure of an antenna according to a second embodiment of the present invention. In this embodiment, an example will be explained in which a planar element 41 which is formed of a semicircular conductive flat plate and is equipped with a cut-out portion 45, and a ground pattern 42 are formed on a printed circuit board (for example, a resin board formed of material such as FR-4, Teflon (registered trademark) or the like) having a dielectric constant of 2 to 5.

The antenna according to the second embodiment comprises the planar element 41, the ground pattern 42 juxtaposed with the planar element 41, and a high-frequency power source connected to the planar element 41. The high-frequency power source is omitted from the illustration of FIG. 6. The planar element 41 is equipped with a projecting portion 41*a* which is connected to the high-frequency power source and constitutes a feed point, a curved portion 41*b* opposite to a side 42*a* of the ground pattern 42, a rectangular cut-out portion 45 concaved from the top portion 41*d* toward the ground pattern 42, and arm portions 41 for securing current paths for low frequencies. The structure of the side is almost the same as FIG. 1B.

The ground pattern 42 is equipped with a recess 47 in which the projecting portion 41*a* of the planar element 41 is accommodated. Accordingly, the side 42*a* opposite to the curved portion 41*b* of the planar element 41 is not straight, but is divided into two sides. The antenna according to this embodiment is designed to be symmetrical with respect to the line 44 passing through the center of the projecting portion 41*a*, which is the feed position. That is, the cut-out portion 45 is also symmetrical. The distance between the curved line 41*b* of the planar element 41 and the side 42*a* of the ground pattern 42 is gradually increased as being farther away from the line 44.

Incidentally, the shape of the cut-out portion 45 is not limited to the rectangle, and the shape of the cut-out portion as described with respect to the first embodiment may be adopted.

Figure 7:
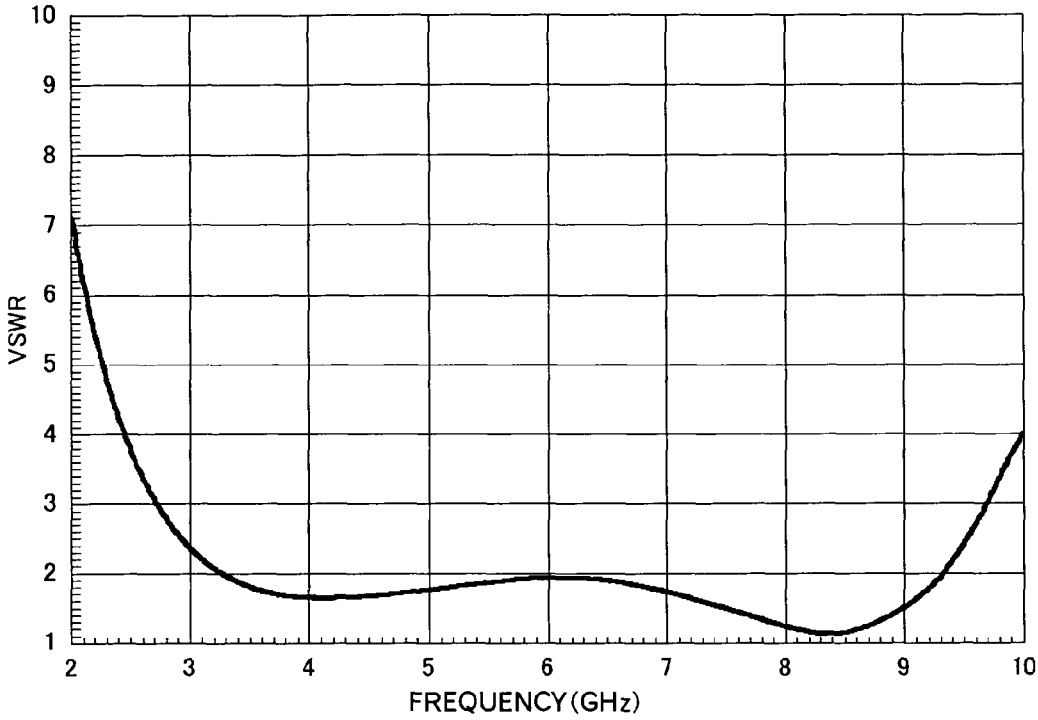
FIG. 7 is a diagram showing the impedance characteristic of the antenna according to the second embodiment.

FIG. 7 is a graph showing the impedance characteristic of the antenna according to this embodiment. In FIG. 7, the axis of ordinate represents VSWR and the axis of abscissa represents the frequency (GHz) Since the frequency bandwidth in which VSRW is not more than 2.5 extends from about 2.9 GHz to about 9.5 GHz, this embodiment has achieved a wide bandwidth antenna. The value of VSWR approaches 2 at about 6 GHz, however, this is permissible. The frequency at which VSWR becomes 2.5 is an extremely low frequency (i.e. about 2.9 GHz) because the cut-out portion 45 is provided.

3. Third Embodiment

Figure 8:
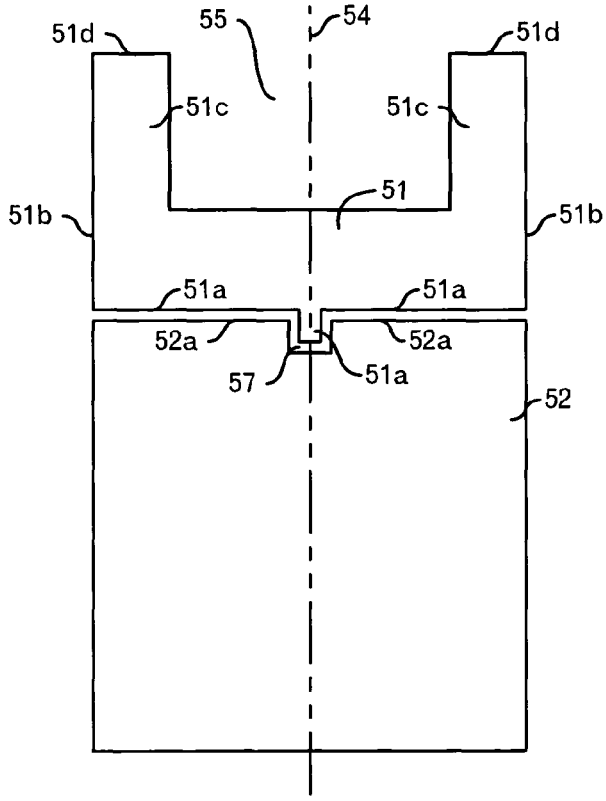
FIG. 8 is a diagram showing the structure of an antenna according to a third embodiment.

FIG. 8 shows the structure of an antenna according to a third embodiment of the present invention. In this embodiment, an example will be explained in which a planar element 51 which is formed of a rectangular conductive flat plate and equipped with a cut-out portion 55, and a ground pattern 52 are formed on a printed circuit board (FR-4, Teflon (registered trademark) or the like) having a dielectric constant of 2 to 5.

The antenna according to the third embodiment comprises the planar element 51, the ground pattern 52 juxtaposed with the planar element 51, and a high-frequency power source connected to the planar element 41. The high-frequency power source is omitted from the illustration of FIG. 8. The planar element 51 is equipped with a projecting portion 51*a* which is connected to the high-frequency power source and constitutes a feed point, a bottom side 51*a* opposite to a side 52*a* of the ground pattern 52, lateral side portions 51*b* connected vertically to the bottom side 51*a*, a rectangular cut-out portion 55 formed by concaving the top portion 51*d* toward the ground pattern 52, and arm portions 51*c* for securing current paths for low frequencies.

The ground pattern 52 is equipped with a recess 57 in which the projecting portion 51*a* of the planar element 51 is accommodated. Accordingly, the side 52*a* opposite to the bottom side 51*a* of the planar element 51 is not straight, but is divided into two sides. The antenna according to this embodiment is symmetrical with respect to a line 54 passing through the center of the projecting portion 51*a*, which is the feed position. Accordingly, the cut-out portion 55 is also symmetrical with respect to the line 54. Furthermore, the structure of the side surface is almost the same as FIG. 1B.

The shape of the cut-out portion 45 is not limited to the rectangle. The shape of the cut-out portion described with respect to the first embodiment may be adopted.

Figure 9:
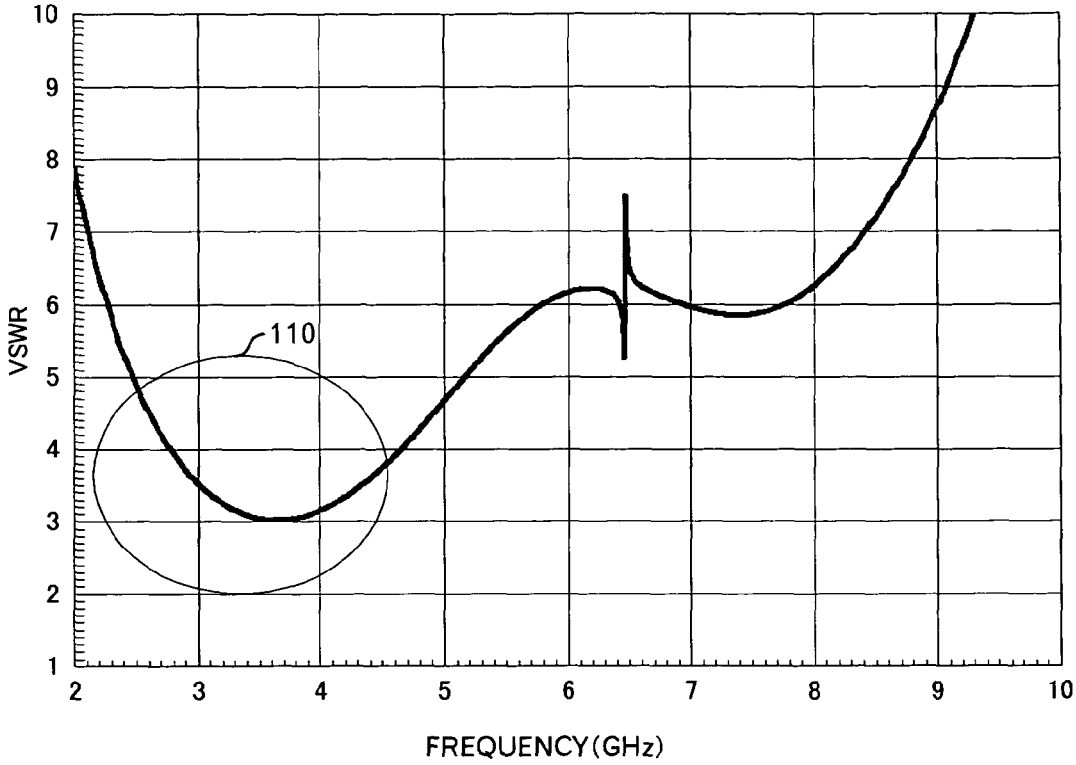
FIG. 9 is a diagram showing the impedance characteristic of the antenna according to the third embodiment.

FIG. 9 shows the impedance characteristic of the antenna according to this embodiment. In FIG. 9, the axis of ordinate represents VSWR and the axis of abscissa represents the frequency (GHz) The antenna of this embodiment does not show a preferable characteristic as a whole. This is because the side 52*a* of the ground pattern 52 and the bottom side 51*a* of the planar element 51 are parallel to each other, and accordingly, the impedance adjustment is not carried out. However, the effect due to the cut-out portion 55 appears at a portion surrounded by an ellipsoid 110, and the lowering degree of the VSWR curve is relatively intense.

The ground pattern 52 may be cut so that the side 52*a* of the ground pattern 52 and the bottom side 51*a* of the planar element 51 are not parallel to each other unlike this embodiment, and the gap between the ground pattern 52 and the planar element 51 is continuously shortened from the outside to the feed point 51*a*. Linear or curved cutting may be carried out as a cutting style.

4. Fourth Embodiment

Figures 10A, 10B:
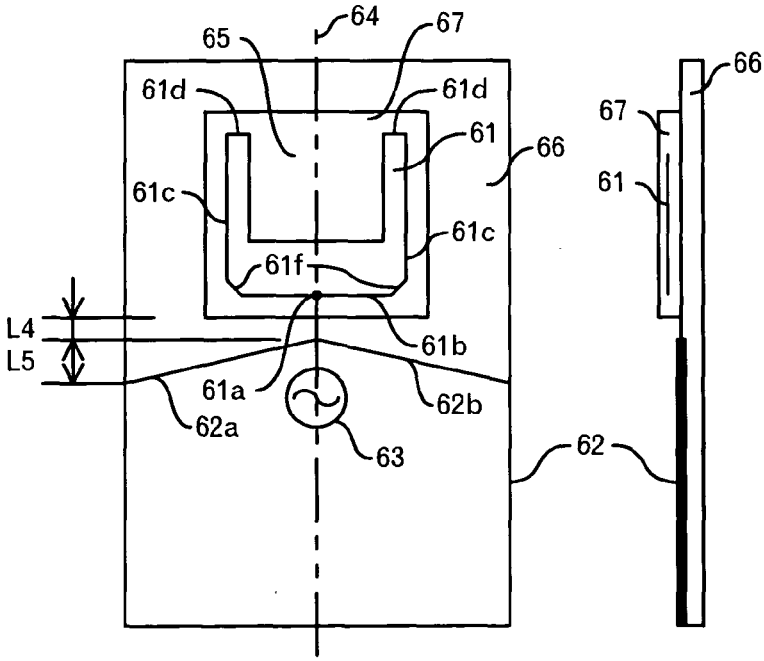
FIG. 10A is a front view showing the structure of an antenna according to a fourth embodiment.
FIG. 10B is a side view of the antenna shown in FIG. 10A.

FIGS. 10A and 10B show the structure of an antenna according to a fourth embodiment. The antenna according to the fourth embodiment includes a dielectric substrate 67 that contains a conductive planar element 61 having a cut-out portion 65 therein and has a dielectric constant of about 20, a ground pattern 62 that is juxtaposed with the dielectric substrate 67 so as to make an interval of L4 (=1.0 mm) from the dielectric substrate 67 and is tapered toward the dielectric substrate 67, a board 66 such as a printed circuit board or the like, and a high-frequency power source 63 connected to a feed point 61*a* of the planar element 61. The size of the dielectric substrate 67 is about 8 mm×10 mm×1 mm. In addition, the bottom side 61*b* of the planar element 61 is vertical to the line 64 passing through the feed point 61*a*, and the lateral sides 61*c* of the planar element 61 are parallel to the line 64. The corners of the bottom side 61*b* of the planar element 61 are splayed and equipped with sides 61*f*. The bottom side 61*b* are connected to the lateral sides 61*c* through the sides 61*f*. A rectangular cut-out portion 65 is provided to the top portion 61*d* of the planar element 61. The cut-out portion 65 is formed by concaving the top in a rectangular shape from the top portion 61*d* toward the ground pattern 62 side. The feed point 61*a* is provided at the intermediate point of the bottom side 61*b*.

In addition, the planar element 61 and the ground pattern 62 are designed to be symmetrical with respect to the line 64 passing through the feed point 61*a*. Accordingly, the cut-out portion 65 is also symmetrical with respect to the line 64. Furthermore, the length (hereinafter referred to as "distance") of a line segment extending from any point on the bottom side 61*b* of the planar element 61 to the ground pattern 62 in parallel with the line 64 is also symmetric with respect to the line 64.

FIG. 10B is a side view of the antenna shown in FIG. 10A, and the ground pattern 62 and the dielectric substrate 67 are provided on the board 66. The board 66 and the ground pattern 62 may be integrally formed with each other. Incidentally, in this embodiment, the planar element 61 is formed inside the dielectric substrate 67. That is, the dielectric substrate 67 is formed by laminating ceramic sheets, and the conductive planar element 61 is formed as one layer of the laminate. Accordingly, when the antenna is viewed from the upper side, it is not actually viewed like FIG. 10A. When the planar element 61 is formed in the dielectric substrate 67, the effect of the dielectric material is slightly stronger as compared with the case where the planar element is exposed, so that the antenna can be more miniaturized and reliability and/or resistance to such as rust or the like is enhanced. However, the planar element 61 may be formed on the surface of the dielectric substrate 67. Furthermore, the dielectric constant may be varied, and the dielectric substrate may be formed in a mono-layer or multi-layer structure. If it is formed in the mono-layer structure, the planar element 61 is formed on the dielectric substrate 67.

Incidentally, in this embodiment, the plane of the dielectric material is arranged in parallel to or substantially in parallel to the plane of the ground pattern 62. This arrangement causes the plane of the planar element 61 contained in one layer of the dielectric substrate 67 to be disposed in parallel to or substantially in parallel to the plane of the ground pattern 62.

When the planar element 61 is formed to be covered by the dielectric substrate 67, the condition of the electromagnetic field around the planar element 61 is varied by the dielectric material. Specifically, since an effect of increasing the density of the electric field in the dielectric material and a wavelength shortening effect can be obtained, the planar element 61 can be miniaturized. Furthermore, the lift-off angle of the current path is varied by these effects, and an inductance component L and a capacitance component C in the impedance equivalent circuit of the antenna are varied. That is, the impedance characteristic is greatly affected. The shape of the planar element 61 is optimized so that a desired impedance characteristic can be achieved in a desired range in consideration for the effect on the aforementioned impedance characteristic.

In this embodiment, the upper edge portions 62*a* and 62*b* of the ground pattern 62 are downwardly inclined from the intersecting point with the line 64 by a height L5 (=2 to 3 mm) at the side edge portions of the grand pattern 62 in the case where the width of the grand pattern 62 is 20 mm. That is, the ground pattern 62 is tapered toward the planar element 61. Since the bottom side 61*b* of the planar element 61 is vertical to the line 64, the distance between the bottom side 61*b* of the planar element 61 and the ground pattern 62 is linearly increased as approaching to the side edge portions.

Figure 11:
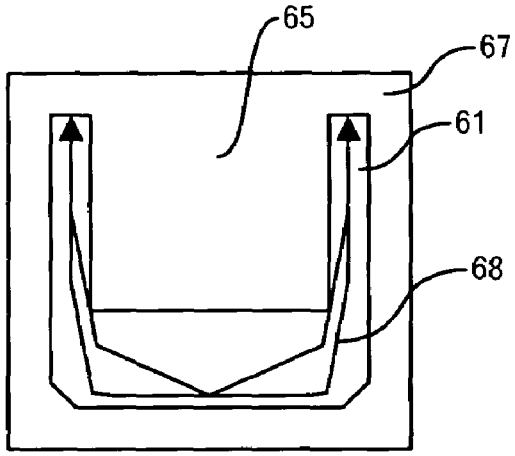
FIG. 11 is a diagram to explain the principle of the operation of the antenna according to the fourth embodiment.

The planar element 61 according to this embodiment is designed to have a shape with a rectangular cut-out portion 65 in order to further enhance miniaturization and secure current paths 68 for achieving a desired frequency bandwidth as shown in FIG. 11. The antenna characteristic can be adjusted by the shape of the cut-out portion 65.

5. Fifth Embodiment

Figure 12:
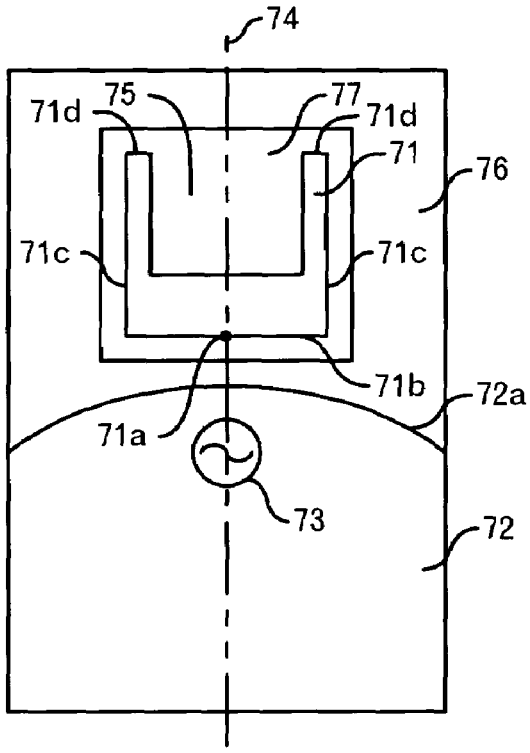
FIG. 12 is a diagram showing the structure of an antenna according to a fifth embodiment.

An antenna according to a fifth embodiment of the present invention comprises a dielectric substrate 77 that contains a planar element 71 therein and has a dielectric constant of about 20, a ground pattern 72 that is juxtaposed with the dielectric substrate 77 and has an arc upper end portion 72*a*, a board 76 such as a printed circuit board or the like, and a high-frequency power source 73 connected to a feed point 71*a* of the planar element 71 as shown in FIG. 12. The size of the dielectric substrate 77 is about 8 mm×10 mm×1 mm. In addition, the bottom side 71*b* of the planar element 71 is vertical to a line 74 passing through the feed point 71*a*, and lateral sides 71*c* connected to the bottom side 71*b* are parallel to the line 74. A cut-out portion 75 is provided to the top portion 71*d* of the planar element 71. The cut-out portion 75 is formed by concaving the top in a rectangular shape from the top portion 71*d* toward the ground pattern 72 side. The feed point 71*a* is provided at the intermediate point of the bottom side 71*b*. The difference between the planar element 61 of the dielectric substrate 67 according to the fourth embodiment and the planar element 71 of the dielectric substrate 77 in this embodiment exists in that the corners of the bottom side are splayed or not splayed.

The planar element 71 and the ground pattern 72 are designed symmetrically with respect to the line 74 passing through the feed point 71*a*. Furthermore, the length (hereinafter referred to as "distance") of a line segment extending from any point on the bottom side 71*b* of the plan element 71 to the ground pattern 72 in parallel to the line 74 is also symmetric with respect to the line 74.

Since the upper edge portion 72*a* of the ground pattern 72 is designed to be an upwardly convex arc, the distance between the planar element 71 and the ground pattern 72 is gradually increased as approaching to the side edge portions of the ground pattern 72. The structure of the side surface is almost the same as FIG. 10B.

A desired impedance characteristic can be achieved in a desired frequency bandwidth by adjusting the curvature of the curved line of the upper edge portion 72*a* of the ground pattern 72.

6. Sixth Embodiment

Figure 13:
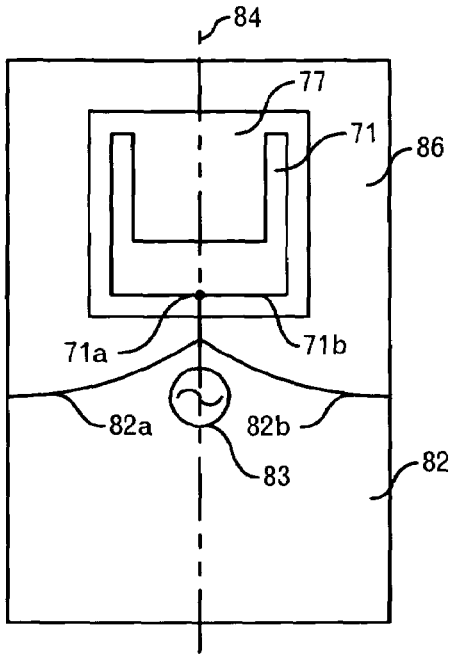
FIG. 13 is a diagram showing the structure of an antenna according to a sixth embodiment.

As shown in FIG. 13, an antenna according to a sixth embodiment of the present invention comprises a dielectric substrate 77 containing a planar element 71 having the same shape as the fifth embodiment, a ground pattern 82 that is juxtaposed with the dielectric substrate 77 and has upper edge portions 82*a* and 82*b* which draw downward saturation curves, a board 86 such as a printed circuit board or the like on which the dielectric substrate 77 and the ground pattern 82 are mounted, and a high-frequency power source 83 connected to a feed point 71*a* of the planar element 71. The ground pattern 82 may be formed inside the board 86.

The planar element 71 and the ground pattern 82 are designed to be symmetric with respect to a line 84 passing through the feed point 71*a*. The length (hereinafter referred to as "distance") of a line segment extending from any point on the bottom side 71*b* of the planar element 71 to the ground pattern 82 in parallel to the line 84 is also symmetric with respect to the line 84.

Since the upper edge portions 82*a* and 82*b* of the ground pattern 82 are downward saturation curves starting from the cross-point between each saturation curve and the line 84, the distance between the planar element 71 and the ground pattern 82 asymptotically approaches a predetermined value as approaching to the side edge portions of the grand pattern 82.

A desired impedance characteristic can be achieved in a desired frequency bandwidth by adjusting the curvature of each of the curved lines of the upper edge portions 82*a* and 82*b* of the ground pattern 82.

7. Seventh Embodiment

Figure 14:
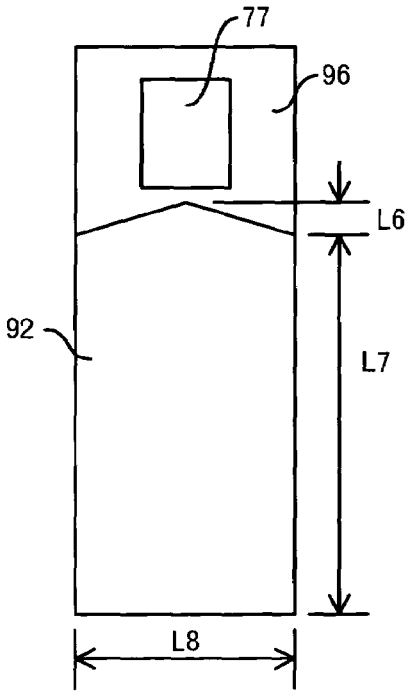
FIG. 14 is a diagram showing the structure of an antenna according to a seventh embodiment.

As shown in FIG. 14, an antenna according to a seventh embodiment of the present invention is composed of a board 96 such as a printed circuit board or the like that comprises a dielectric substrate 77 containing a planar element having the same shape as the fifth embodiment and a ground pattern 92 having such a shape as described below, and a high-frequency power source (not shown). That is, the length of the side edge portions of the ground pattern 92 is 35 mm (=L7), and the lateral width is 20 mm (=L8). In addition, the upper edge portion of the ground pattern 92 is tapered so that the difference in height between the uppermost position of the upper edge portion and each end position thereof at the side edge portion is 3 mm (=L6).

Figure 15:
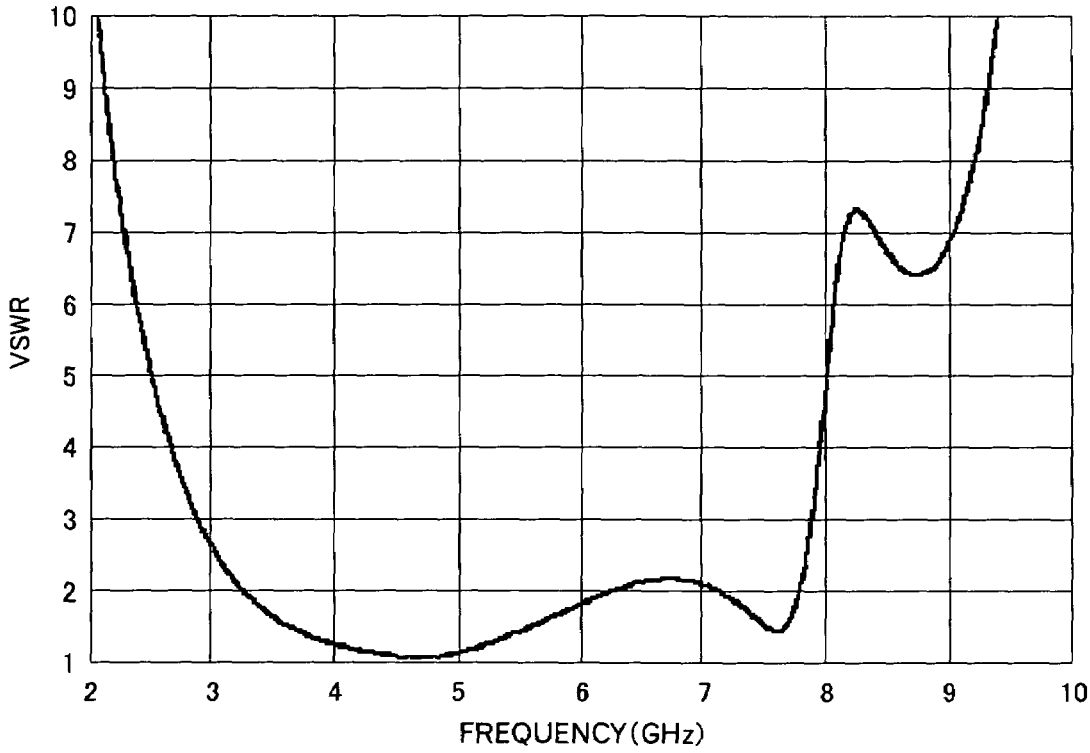
FIG. 15 is a diagram showing the impedance characteristic of the antenna according to the seventh embodiment.

The impedance characteristic of such an antenna is shown in FIG. 15. In the graph of FIG. 15, the axis of ordinate represents VSWR, and the axis of abscissa represents the frequency (GHz). For example, the frequency bandwidth in which VSWR is not more than 2.5 approximately extends from about 3.1 GHz to about 7.8 GHz. Though a range where the value of VSWR is greatly varied exists in the high-frequency range, the bandwidth at the low-frequency side is widened like VSWR is equal to 2.5 at about 3.1 GHz. As described above, the impedance characteristic at the low-frequency side is improved by the planar element having the cut-out portion.

8. Eighth Embodiment

Figure 16:
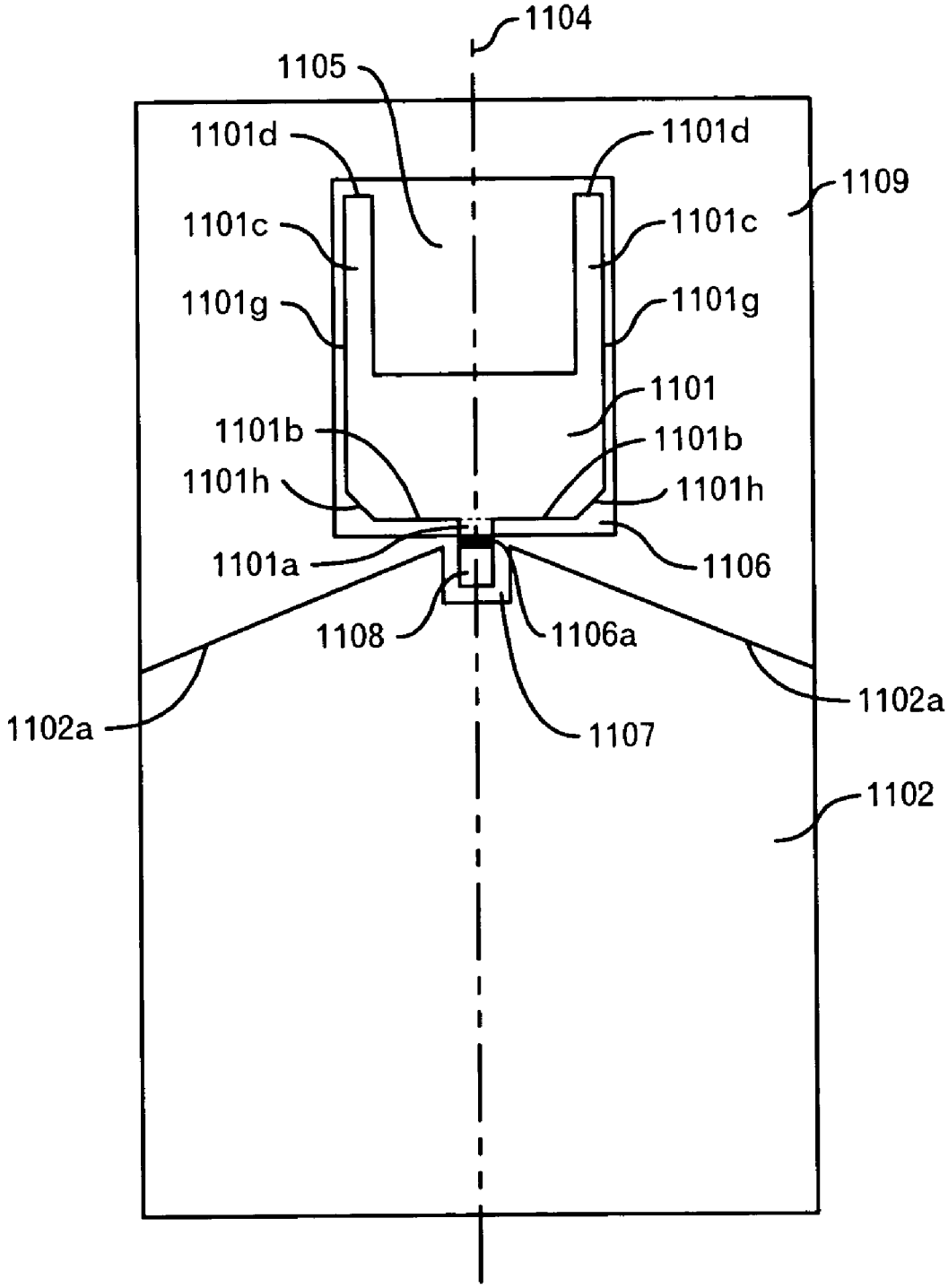
FIG. 16 is a diagram showing the structure of an antenna according to an eighth embodiment.

The structure of an antenna according to an eighth embodiment of the present invention is shown in FIG. 16. In this embodiment, an example will be explained in which a planar element 1101 that is formed of a rectangular conductive flat plate and has a cut-out portion 1105 is formed in a dielectric substrate 1106 having a dielectric constant of about 20. The antenna according to this embodiment comprises the dielectric substrate 1106 that contains the planar element 1101 therein and has an external electrode 1106*a* at the outside thereof, a feed portion 1108 that is connected to a high-frequency power source (not shown) to supply power to the planar element 1101 and connected to the external electrode 1106*a* of the dielectric substrate 1106, and a ground pattern 1102 that has a recess 1107 for accommodating the feed portion 1108 and is formed on or in a board 1109 such as a printed circuit board or the like.

The external electrode 1106*a* is connected to a projecting portion 1101*a* of the planar element 1101, and extends to the back surface (i.e. dotted line portion of the back surface) of the dielectric substrate 1106. The feed portion 1108 contacts with the external electrode 1106*a* that is provided on the end portion of the side surface and the back surface of the dielectric substrate 1106, and the feed portion 1108 and the external electrode 1106*a* are overlapped in the dotted line portion.

The planar element 1101 is equipped with a projecting portion 1101*a* connected to the external electrode 1106*a*, a side 1101*b* opposite to a side 1102*a* of the ground pattern 1102, arm portions 1101*c* for securing current paths for low frequencies, and a rectangular cut-out portion 1105 formed so as to concave from the top portion 1101*d* toward the ground pattern 1102. The side 1101*b* and the lateral side portions 1101*g* are connected to each other through sides 1101*h* formed by splaying the side 1101*b*. The dielectric substrate 1106 containing the planar element 1101 is juxtaposed with the ground pattern 1102.

Incidentally, in this embodiment, the planar element 1101 is formed inside the dielectric substrate 1106. That is, the dielectric substrate 1106 is formed by laminating ceramic sheets, and the conductive planar element 1101 is formed as one layer of the laminate. Accordingly, when viewed from the upper side, the planar element 1101 is not actually viewed like FIG. 16. However, the planar element 1101 may be formed on the surface of the dielectric substrate 1106.

Since the recess 1107 for accommodating the feed portion 1108 is provided to the ground pattern 1102, the side 1102*a* opposite to the side 1101*b* of the planar element 1101 is not straight, but divided into two sides. The antenna according to this embodiment is symmetric with respect to a line 1104 passing through the center of the feed portion 1108, which is the feed position. The rectangular cut-out portion 1105 is also symmetrical with respect to the line 1104. The side 1102*a* is inclined so that the distance between the side 1101*b* of the planar element 1101 and the side 1102*a* of the ground pattern 1102 is linearly increased as being farther away from the line 1104. That is, the ground pattern 1102 has a tapered shape toward the dielectric substrate 1106. The structure of the side surface is almost the same as FIG. 10B except for the portions corresponding to the feed portion 1108 and the external electrode 1106*a*.

Figure 17:
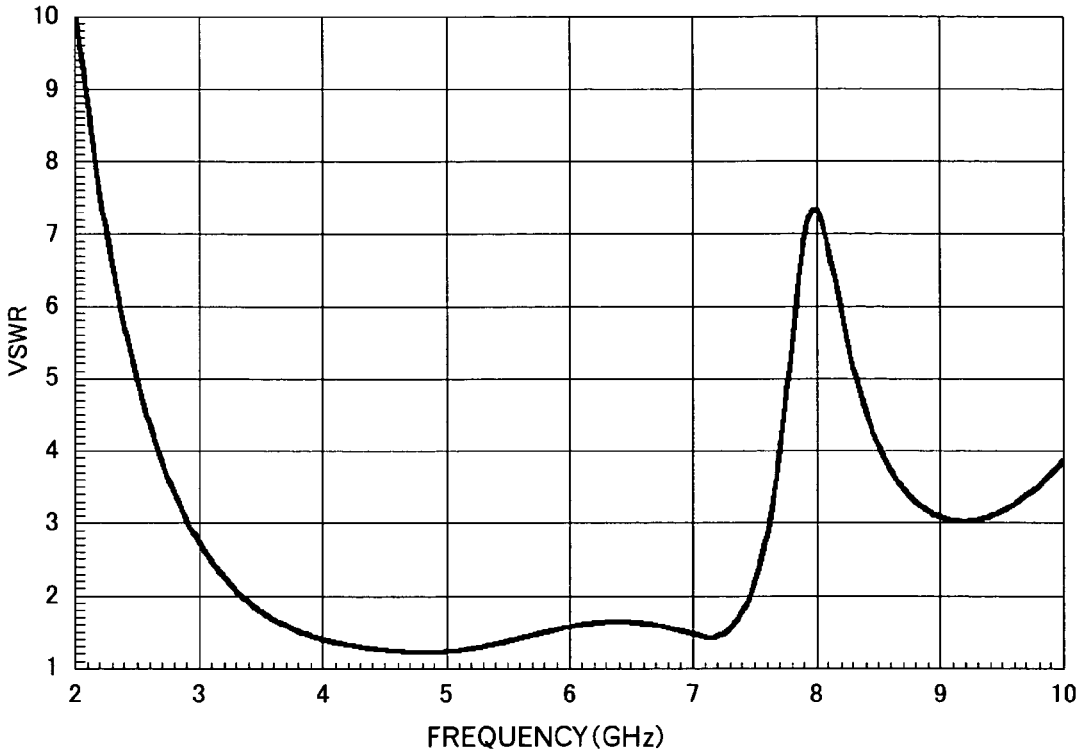
FIG. 17 is a diagram showing the impedance characteristic of the antenna according to the eighth embodiment.

FIG. 17 shows the impedance characteristic of the antenna according to this embodiment. In FIG. 17, the axis of ordinate represents VSWR, and the axis of abscissa represents the frequency (GHz). The frequency bandwidth in which VSWR is not more than 2.5 extends from about 3.1 GHz to about 7.6 GHz. Though a range where the value of VSWR is greatly varied exists in the high-frequency range, the range at the low-frequency side is widened like VSWR is equal to 2.5 at about 3.1 GHz. As described above, the impedance characteristic at the low-frequency side is improved by the planar element having the cut-out portion.

9. Ninth Embodiment

Figure 18:
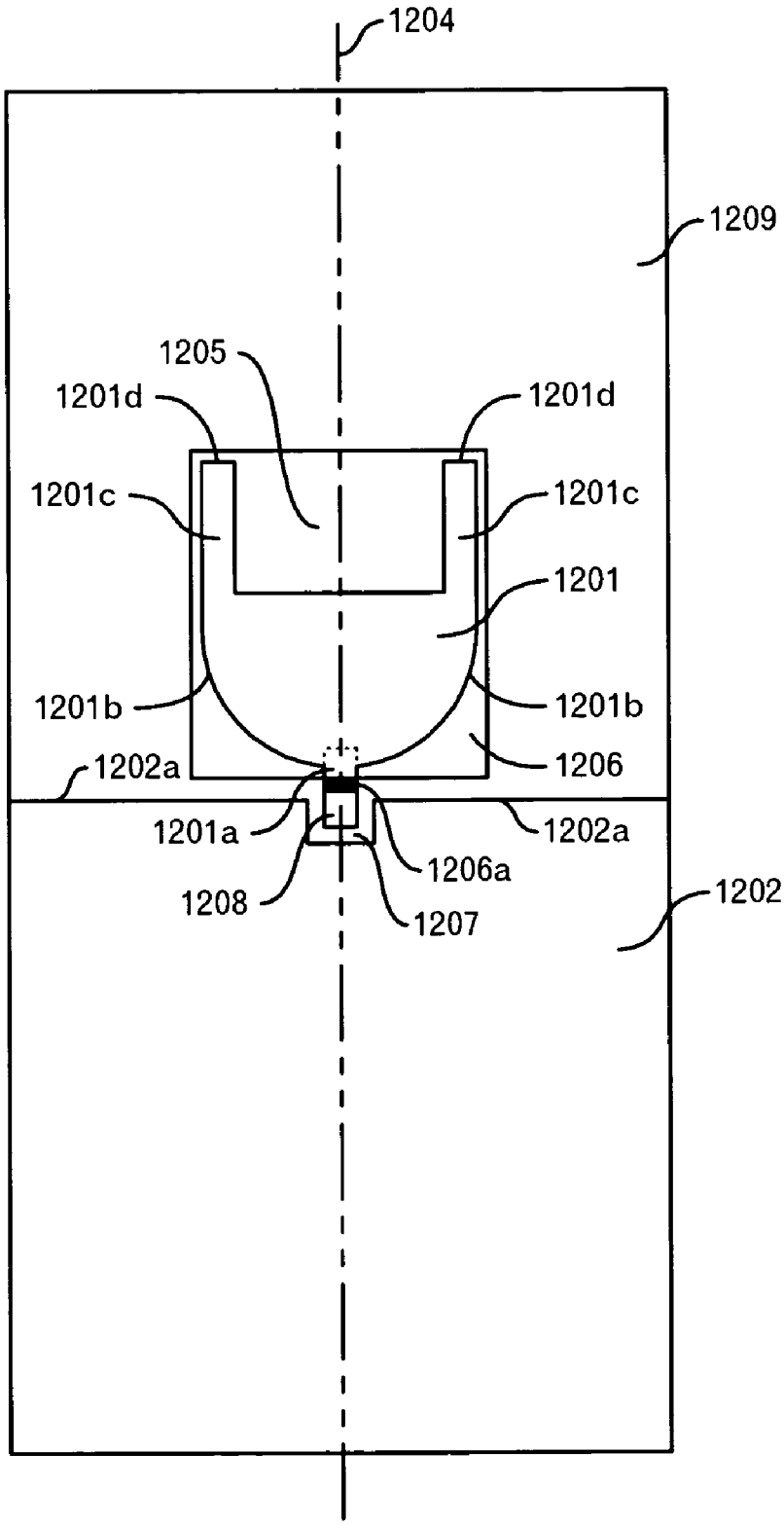
FIG. 18 is a diagram showing the structure of an antenna according to a ninth embodiment.

FIG. 18 shows the structure of an antenna according to a ninth embodiment of the present invention. In this embodiment, an example will be explained in which a planar element 1201 having a curved portion opposite to the edge of a ground pattern 1202 unlike the planar element of the eighth embodiment is formed in a dielectric substrate 1206 having a dielectric constant of about 20. The antenna according to the ninth embodiment comprises a dielectric substrate 1206 that contains a conductive planar element 1201 and equipped with an external electrode 1206*a* at the outside thereof, a feed portion 1208 that is connected to a high-frequency power source (not shown) to supply power to the planar element 1201 and connected to the external electrode 1206*a* of the dielectric substrate 1206, and a ground pattern 1202 that has a recess 1207 for accommodating the feed portion 1208 therein and is formed in or on a board 1209 such as a printed circuit board or the like. The external electrode 1206*a* is connected to a projecting portion 1201*a* of the planar element 1201, and extends to the back surface (i.e. dotted line portion of the back surface) of the dielectric substrate 1206. The feed portion 1208 contacts with the external electrode 1206*a* provided on the edge portion of the side surface of the dielectric substrate 1206 and the back surface, and the feed portion 1208 and the external electrode 1206*a* are overlapped with the dotted line portion.

The planar element 1201 is equipped with a projecting portion 1201*a* connected to the external electrode 1206*a*, a curved line portion 1201*b* opposite to a side 1202*a* of the ground pattern 1202, arm portions 1201*c* for securing current paths for low frequencies, and a rectangular cut-out portion 1205 formed so as to concave from the top portion 1201*d* toward the ground pattern 1202. The dielectric substrate 1206 containing the planar element 1201 is juxtaposed with the ground pattern 1202.

Incidentally, in this embodiment, the planar element 1201 is formed inside the dielectric substrate 1206. That is, the dielectric substrate 1206 is formed by laminating ceramic sheets, and the conductive planar element 1201 is formed as one layer of the laminate. Accordingly, when viewed from the upper side, the planar element 1201 is not actually viewed like FIG. 18. If the planar element 1201 is formed inside the dielectric substrate 1206, the effect of the dielectric material is slightly stronger as compared with the case where it is exposed, so that the miniaturization can be more enhanced and reliability and/or resistance to such as rust or the like can be enhanced. However, the planar element 1201 may be formed on the surface of the dielectric substrate 1206.

The ground pattern 1202 is provided with the recess 1207 for accommodating the feed portion 1208. Therefore, the side 1202*a* opposite to the curved portion of the planar element 1201 is not straight, but divided into two sides. The antenna according to this embodiment is symmetrical with respect to a line 1204 passing through the center of the feed portion 1208. The rectangular cut-out portion 1205 is also symmetrical with respect to the line 1204. The distance between the curved line 1201*b* of the planar element 1201 and the side 1202*a* of the ground pattern 1202 is gradually increased as being farther away from the line 1204, and it is symmetric with respect to the line 1204. The structure of the side surface is almost the same as FIG. 10B except for the portions corresponding to the feed portion 1208 and the external electrode 1206*a*.

Figure 19:
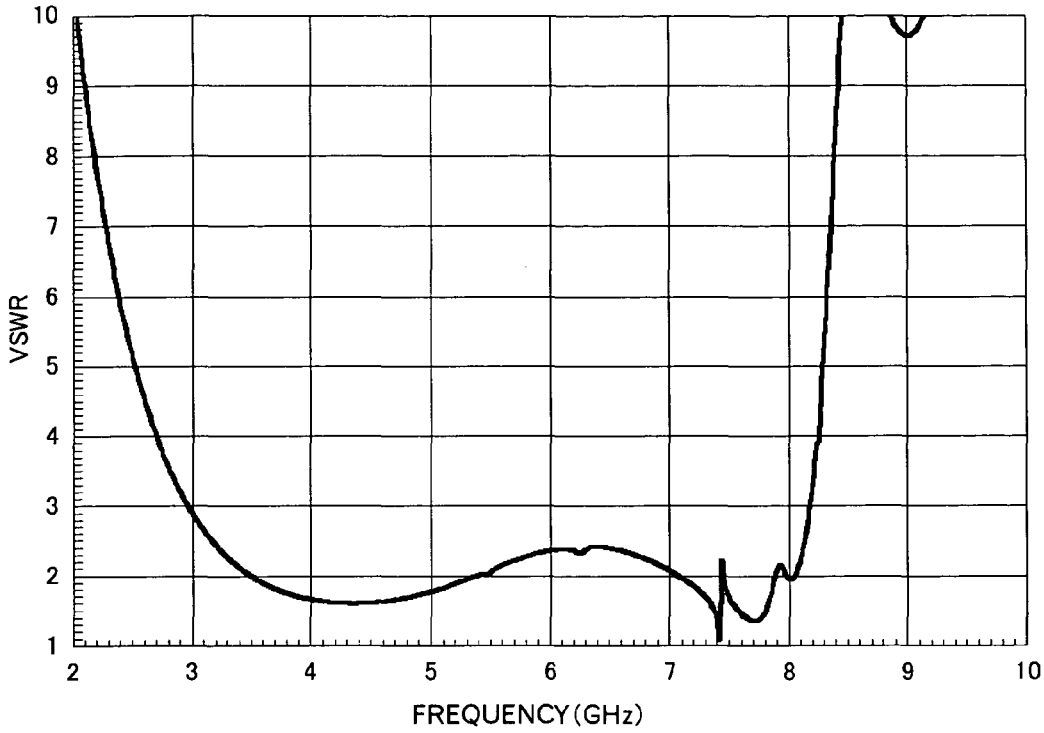
FIG. 19 is a diagram showing the impedance characteristic of the antenna according to the ninth embodiment.

FIG. 19 shows the impedance characteristic of the antenna according to this embodiment. In FIG. 19, the axis of ordinate represents VSWR and the axis of abscissa represents the frequency (GHz) The frequency bandwidth in which VSWR is not more than 2.5 extends from about 3.2 GHz to about 8.2 GHz. Comparing the impedance characteristic of the eighth embodiment (FIG. 17) and the impedance characteristic of this embodiment (FIG. 19), these characteristics in the low frequency range are substantially the same, however, they are greatly different in the high-frequency range. Comparing the shape of the planar element 1101 of the eighth embodiment and the shape of the planar element 1201 of this embodiment, the same shape is used at the portion where the rectangular cut-out portion exists. Therefore, also from the comparison between FIGS. 17 and 19, it is apparent that the rectangular cut-out portion contributes to the improvement of the characteristic in the low frequency range. On the other hand, comparing the shape of the planar element 1101 of the eighth embodiment and the shape of the planar element 1201 of this embodiment, they are different in the distance between the planar element and the ground pattern, and it is apparent from the comparison between FIGS. 17 and 19 that this different portion affects the overall characteristic, especially the characteristic in the high-frequency range.

10. Tenth Embodiment

Figure 20:
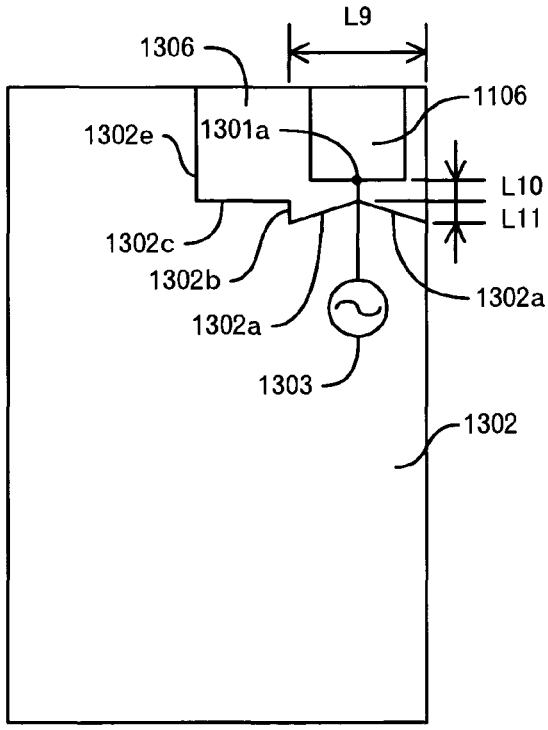
FIG. 20 is a diagram showing the structure of a communication card according to a tenth embodiment.

FIG. 20 shows a printed circuit board 1306 of a wireless communication card according to a tenth embodiment of the present invention. The printed circuit board 1306 according to this embodiment has the same dielectric substrate 1106 as the dielectric substrate of the eighth embodiment, a high-frequency power source 1303 connected to a feed point 1301*a* and a ground pattern 1302. The dielectric substrate 1106 is disposed at the upper right end portion of the printed circuit board 1306 so as to be spaced from the ground pattern 1302 at a distance of L10 (=1 mm). The side 1302*a* opposite to the dielectric substrate 1106 is tapered toward the feed point 1301*a*. The shortest distance between the ground pattern 1302 and the dielectric substrate 1106 is equal to L10. The difference L11 in height between the nearest point of the ground pattern 1302 to the feed point 1301*a* and the cross point between a lateral edge portion of the printed circuit board 1306 and the side 1302*a* is equal to 2 to 3 mm. The side 1302*a* is designed symmetrically with respect to a line passing through the feed point 1301*a*. The left-side side 1302*a* is connected to a vertical side 1302*b* of L11 in length, and the side 1302*b* is connected to a horizontal side 1302*c*. In this embodiment, the side 1302*c* is further connected to the vertical side 1302*e*. Accordingly, the ground pattern 1302 is designed to have such a shape as to partially surround the dielectric substrate 1106 by the side 1302*e*, the side 1302*c*, the side 1302*b* and the side 1302*a*. That is, the ground pattern 1302 is formed to have an opening to at least a part of the edge portion, which contains the cut-out portion 1105, of the planar element 1101 without fully surrounding the edge portion of the planar element 1101. In this embodiment, no ground pattern 1302 is equipped toward the upper edge portion containing the cut-out portion 1105 and the right side edge portion of the planar element 1101, and if no consideration is given to the cover of the printed circuit board 1306, it is regarded that an opening is provided to the ground pattern 1302. Incidentally, L9 is equal to 10 mm.

Figure 21:
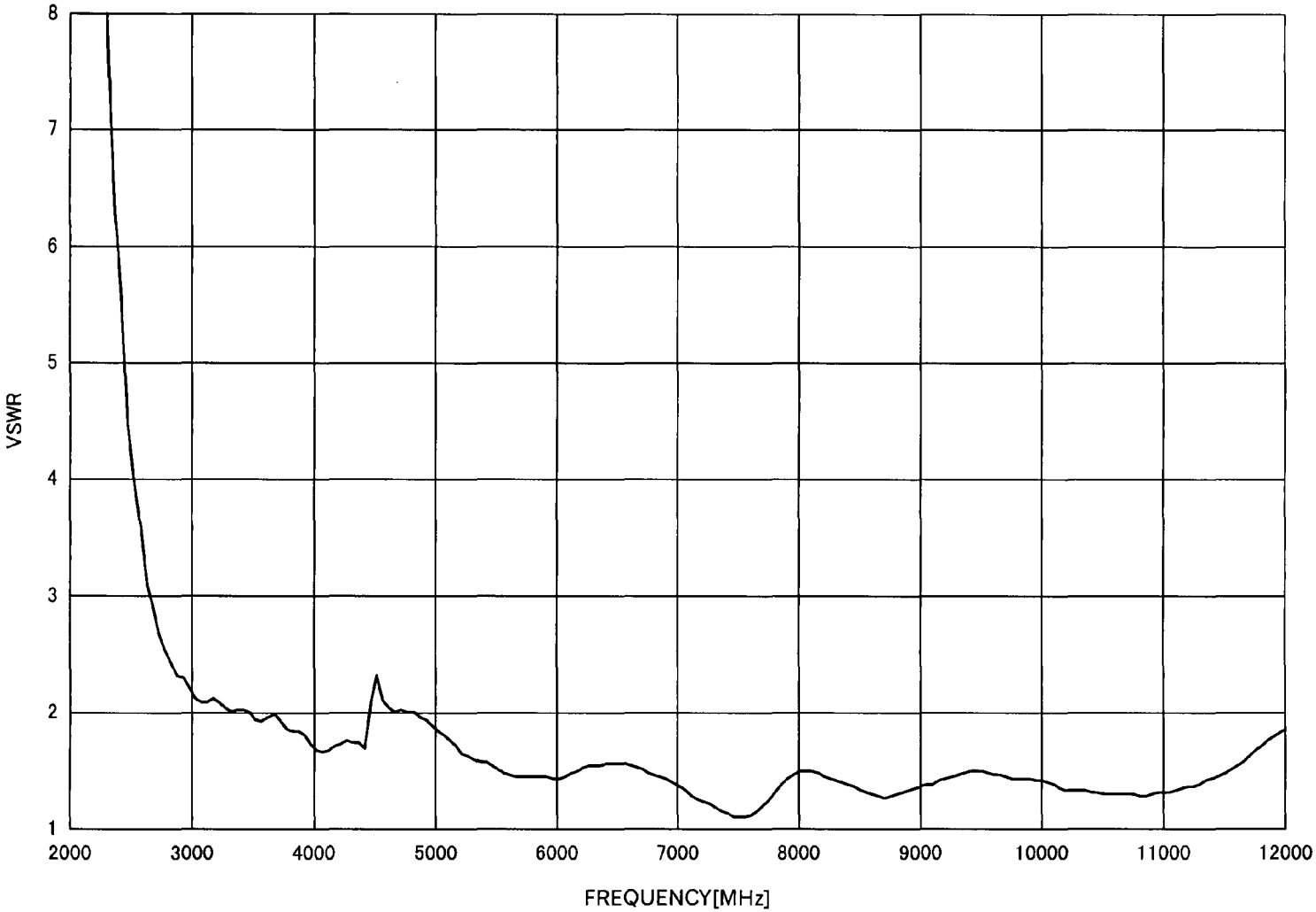
FIG. 21 is a diagram showing the impedance characteristic of the communication card according to the tenth embodiment.
Figures 1, 22A:
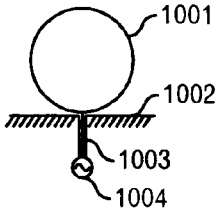
Figures 2, 22A:
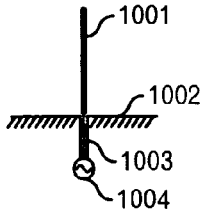
Figures 1, 22B:
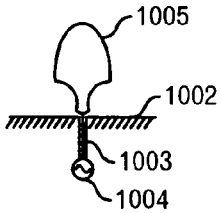
Figures 2, 22B:
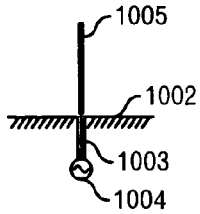
Figure 22C:
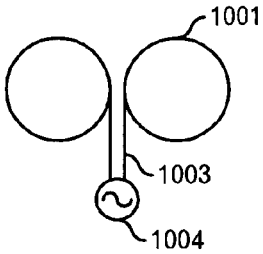
Figure 22D:
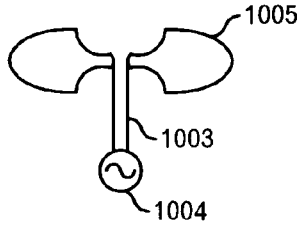
Figure 22E:
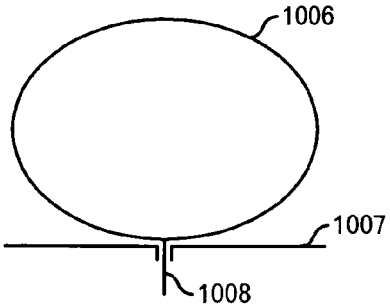
Figure 22F:
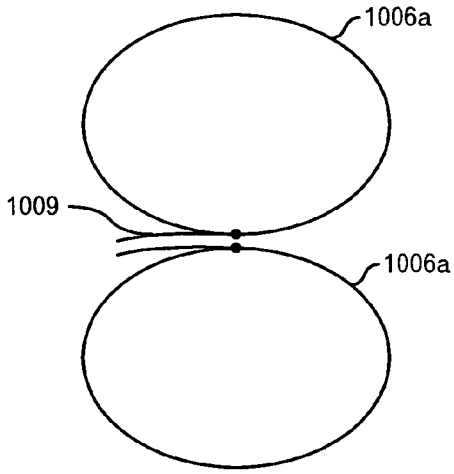
Figure 22G:
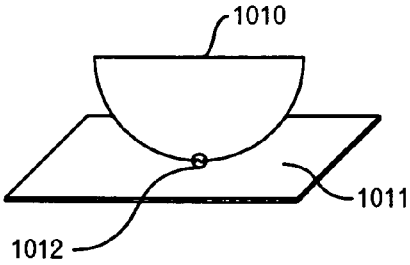
Figure 22H:
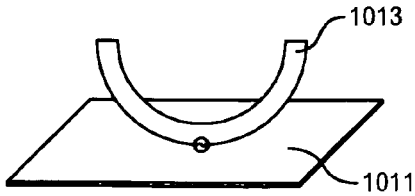
Figure 22I:
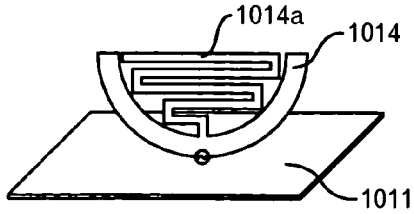
FIG.22I PRIOR ART
Figure 23:
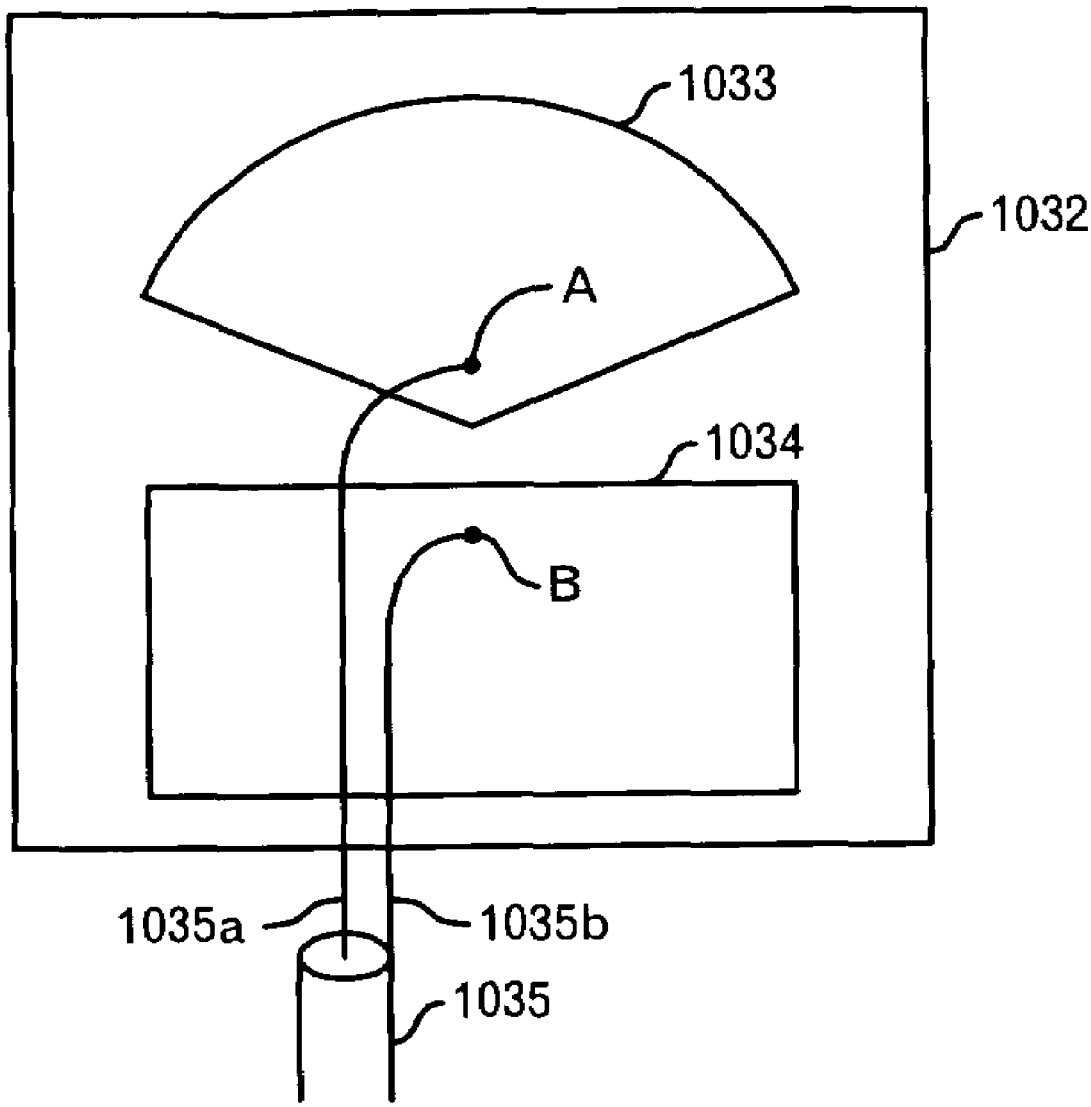
FIG.23 PRIOR ART
FIG. 23 is a diagram showing the structure of a conventional antenna.
Figure 24:
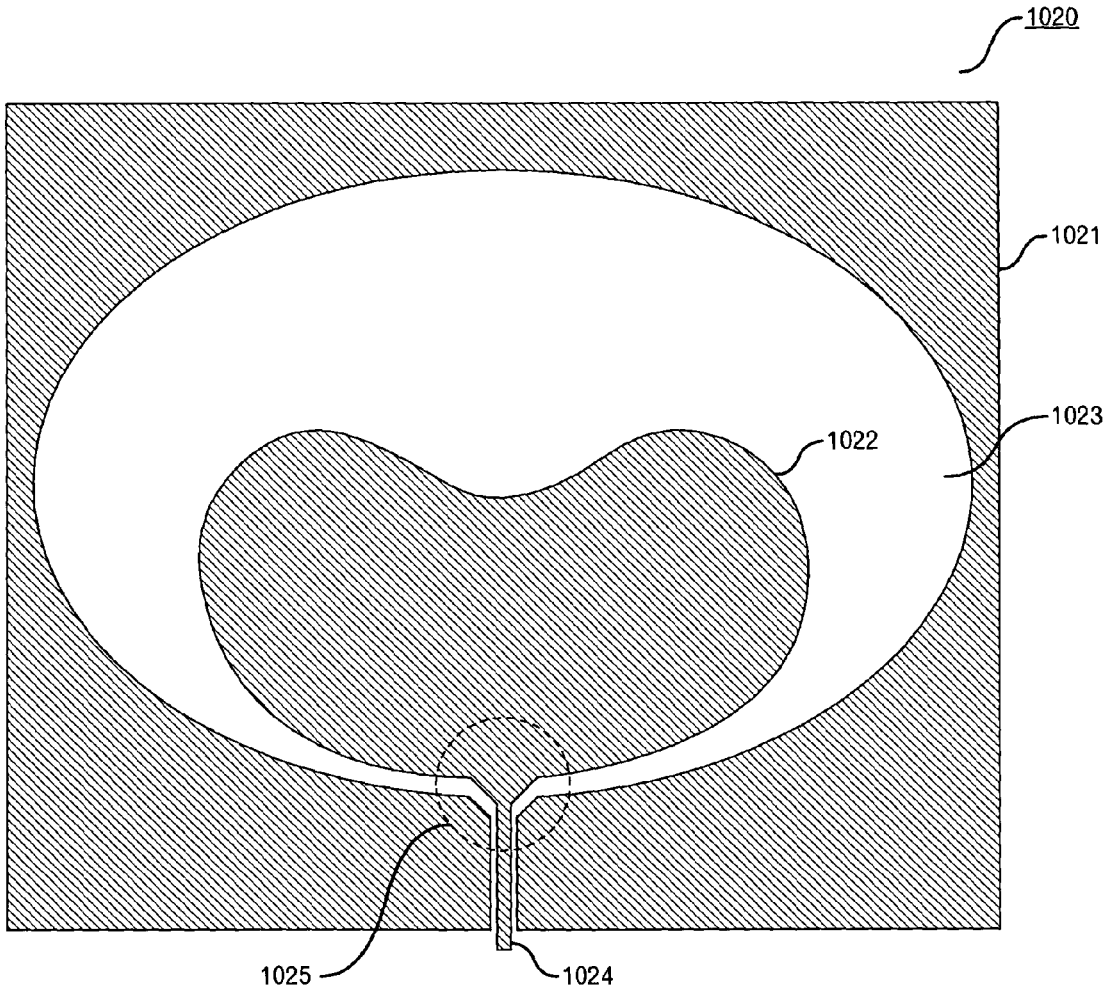
FIG.24 PRIOR ART
FIG. 24 is a diagram showing the structure of a conventional antenna.

FIG. 21 shows the impedance characteristic of the antenna shown in FIG. 20. Incidentally, the axis of ordinate represents VSWR, and the axis of abscissa represents the frequency (MHz). From observation of the curve of VSWR, the value of VSWR is kept not more than 2 at frequencies of about 3500 MHz or more, except that a low peak occurs at about 4500 MHz. If the threshold value of VSWR is set to about 2.4, an ultra wide bandwidth from about 3000 MHz to 12000 MHz is achieved. Incidentally, in this case, it is apparent that not only the shape of the planar element having the cut-out portion, but also the shape of the ground pattern, particularly, the ground pattern at the left side of the side 1302*e* contributes to the improvement of the characteristic.

Although the embodiments of the present invention have been described, this invention is not limited to those embodiments. The rectangular shape is representatively used as the shape of the cut-out portion as described above. However, a trapezoidal shape or polygonal shape may be used as occasion demands. Furthermore, the processing of rounding the corners of the cut-out portion may be carried out.

Although the present invention has been described with respect to a specific preferred embodiment thereof, various change and modifications may be suggested to one skilled in the art, and it is intended that the present invention encompass such changes and modifications as fall within the scope of the appended claims.

What is claimed is:

1. An antenna, comprising:

a ground pattern; and a planar element that is conductive and includes (i) an edge portion positioned away from the ground pattern, (ii) a feed point and (iii) a cut-out portion formed at the edge portion, wherein said ground pattern and said planar element are juxtaposed with each other extending along opposite directions respectively, and said planar element has such a shape that a bottom side thereof is adjacent to the ground pattern, lateral sides thereof are provided vertically or substantially vertically to said bottom side and said cut-out portion is provided in a top side thereof.

2. The antenna as set forth in claim 1, wherein both corners of said bottom side are splayed.

3. An antenna dielectric substrate, comprising:

a layer formed of a dielectric material; and a layer containing a conductor having a cut-out portion formed from an edge portion nearest to a first side surface of said antenna dielectric substrate toward a second side surface opposite to said first side surface, wherein said conductor has such a shape that a side thereof nearest to said second side surface is a bottom side, lateral sides thereof are provided vertically or substantially vertically to said bottom side and said cut-out portion is provided in a top side nearest to said first side surface.

4. The antenna dielectric substrate as set forth in claim 3, wherein both corners of said bottom side are splayed.

* * * * *